US008456091B2

(12) United States Patent
Goitiandia et al.

(10) Patent No.: US 8,456,091 B2
(45) Date of Patent: Jun. 4, 2013

(54) METHOD AND APPARATUS FOR MAINTAINING CONSTANT COLOR TEMPERATURE OF A FLUORESCENT LAMP

(75) Inventors: Ray Goitiandia, Los Angeles, CA (US); Frieder Hochheim, Los Angeles, CA (US); Mark Primrose, Burbank, CA (US)

(73) Assignee: Kino Flo, Inc., Burbank, CA (US)

( * ) Notice: Subject to any disclaimer, the term of this patent is extended or adjusted under 35 U.S.C. 154(b) by 519 days.

(21) Appl. No.: 12/553,920
(22) Filed: Sep. 3, 2009
(65) Prior Publication Data

US 2010/0060171 A1 Mar. 11, 2010

Related U.S. Application Data

(60) Provisional application No. 61/095,595, filed on Sep. 9, 2008.

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |

(52) U.S. Cl.
USPC ..... 315/152; 315/187; 315/312; 315/246; 315/291; 362/260; 362/227; 362/613

(58) Field of Classification Search
USPC ..... 315/152, 95, 187, 227, 231, 324, 315/363, 192, 312, 246, 250, 291, 294, 404, 315/74, 197; 313/483, 489; 362/260, 227–229, 362/612, 628, 555, 231, 613, 614, 605, 800; 349/68
See application file for complete search history.

(56) References Cited

U.S. PATENT DOCUMENTS

| | | | | |
|---|---|---|---|---|
| 4,928,038 | A | 5/1990 | Nerone | |
| 4,935,635 | A | 6/1990 | O'Harra | |
| 6,509,675 | B2 * | 1/2003 | MacLennan et al. | 313/113 |
| 6,639,349 | B1 | 10/2003 | Bahadur | |

(Continued)

FOREIGN PATENT DOCUMENTS

| | | |
|---|---|---|
| JP | 59196535 | 11/1984 |
| JP | 60136156 | 7/1985 |
| JP | 2002-260409 | 9/2002 |

*Primary Examiner* — Shawki Ismail
*Assistant Examiner* — Dylan White
(74) *Attorney, Agent, or Firm* — Blakely, Sokoloff, Taylor & Zafman

(57) ABSTRACT

A system to allow a fluorescent lamp to be dimmed or otherwise improve color performance of the lamp while maintaining a constant spectral distribution. In one embodiment, the lamp will dim in light output and not shift in color temperature. An LED array is positioned under a fluorescent lamp such that its light injects back into the lamp that part of the color spectrum that diminishes as a fluorescent lamp dims. The LED array is positioned centrally along the underside of the lamp. The light from the LED is never directly visible but shines through the lamp; the lamp acting as a diffuser. The brightness level of the LEDs can be determined as a preset level relative to a predetermined dim setting or can be regulated through an electronic monitoring sensor. The monitoring could evaluate the shift in color spectrum and or intensity and render the appropriate injection of light spectrum to maintain a constant unwavering color temperature.

17 Claims, 5 Drawing Sheets

U.S. PATENT DOCUMENTS

| | | | | |
|---|---|---|---|---|
| 7,265,902 | B2 * | 9/2007 | Lee et al. | 359/463 |
| 7,288,902 | B1 * | 10/2007 | Melanson | 315/291 |
| 7,334,932 | B2 * | 2/2008 | Klettke | 362/612 |
| 7,498,753 | B2 * | 3/2009 | McAvoy et al. | 315/291 |
| 7,719,016 | B2 * | 5/2010 | Nada et al. | 257/95 |
| 8,102,127 | B2 * | 1/2012 | Melanson | 315/178 |
| 2007/0046485 | A1 | 3/2007 | Grootes et al. | |
| 2007/0053182 | A1 * | 3/2007 | Robertson | 362/228 |
| 2008/0224635 | A1 * | 9/2008 | Hayes | 315/297 |
| 2010/0259182 | A1 * | 10/2010 | Man et al. | 315/250 |

* cited by examiner

METHOD AND APPARATUS FOR MAINTAINING CONSTANT COLOR TEMPERATURE OF A FLUORESCENT LAMP

This is a non-provisional claiming priority based on provisional application Ser. No. 61/095,595 filed Sep. 9, 2008.

FIELD OF THE INVENTION

Fluorescent lighting systems with dimming controls.

BACKGROUND OF INVENTION

Fluorescent lighting has gained prominence over the last 20 years as a light source for motion picture production and other color critical imaging applications. The many advantages of low power consumption, low heat, lightweight fixture designs, quiet ballasts and high color rendering lamps have all contributed to an industry wide acceptance of the technology.

The more recent introduction of stable dimming technology has presented an unforeseen problem for lighting professionals in the imaging industries. As fluorescent lamps are dimmed the lamps shift in color temperature. The shift in color temperature is very different from dimming an incandescent. The difference is best viewed or understood when comparing the color tracking points of the two sources in a CIE color space. The CIE (1931) color space has a black body color temperature curve or a Planckian locus. The curve defines the color temperature of a black body emitter such as a lamp filament as it glows from darkness to its final brightness or operating voltage. In photographic terms, film would see a lamp going from a very orange light to a white light at its brightest dimmer setting. A fluorescent lamp on the other hand does not follow the Planckian curve. As a fluorescent is dimmed it wanders off the curve and falls below it. This is an area of the CIE color space that defines the amount of magenta in the spectrum. The only shift in spectrum when dimming a fluorescent is in the green/magenta range. Since correlated color temperature is a mathematical calculation the color temperature is represented as dropping in temperature when in fact, unlike an incandescent, it is only shifting along a vertical axis below the Planckian curve.

The color temperature shift of an incandescent is greater that a fluorescent. For example, in photographic terms a four f' stop dimming range in incandescent will result in color temperature going from 3200K to 2164K; a drop of 1036 Kelvin. There will be no shift in the green/magenta spectrum. In a fluorescent the same dimming range will result in a shift from 3200K to 2735K a drop of only 465 Kelvin, however there is a marked decrease in green spectrum.

This type of spectral shift in the green results in digital camera or film technology rendering colors incorrectly. This can be most noticeable on skin tones. For example a more magenta light source makes a Caucasian skin tone appear not just warmer as it would with a dimmed incandescent but unnaturally magenta. If the skin tone were to be corrected electronically in postproduction the background image lit by an undimmed fluorescent would appear green. This condition is unacceptable.

In order to understand the color shift, it is important to understand the mechanics of how a fluorescent lamp is illuminated. A fluorescent lamp is made up of a blend of various phosphors applied to the interior wall of a tubular light source. The phosphor lights up when exposed to ultraviolet light. This ultraviolet light is achieved by establishing a plasma arc stream through a mercury vapor atmosphere in a tubular lamp. The plasma arc is an electron stream established between two cathodes at opposite ends of the lamp. If just the arc stream could be viewed, it would appear as a blue green light. On a spectral distribution chart the arc would appear to have a very high energy spike at around the 550 nanometer range.

The color rendering of a fluorescent lamp is defined and tailored to be correct at its maximum light output. This is also the point at which the lamp is experiencing the highest mercury vapor pressure. This is when the arc is at its most blue/green and the lamp is at its brightest.

As in an incandescent lamp, as a fluorescent lamp is dimmed, light output and Kelvin temperature drops. Unlike incandescent, as the fluorescent lamp cools the mercury vapor pressure within the lamp drops resulting in a lowering of the green spectrum and the overall color temperature. This drop in green makes a lamp appear more magenta. Photographers would use a photographic color meter such as a hand held Minolta® color meter or a Sekonic® color meter to measure the drop in color temperature. The meters would calculate the amount of additive green filtration necessary to bring the light back in line to what the spectrum was prior to dimming.

Fluorescent lamps have a long history of requiring color correction gels to absorb parts of the spectrum that render colors on film inaccurately. The down side of color correction gels or filters applied directly to a fixture is that the light takes on the coloration of the gel/filter. That is to say, human eyes perceive the colored gel more so than the imaging technology that now renders or sees the light correctly. This hinders artists such as art directors or cinematographers from accurately evaluating and appreciating how the range of colors and tones will reproduce on film or digitally.

It is known in the art (e.g., U.S. Pat. No. 7,014,336) to provide a collection of LEDS representing the range of visible light to be individually attenuated in such a way as to simulate existing alternate light sources and their distinct spectral curves. This patent also shows an embodiment of a tubular light source populated with multiple LEDS to simulate and be used in place of a fluorescent tube. The patent also reveals a system of monitoring a given source spectrally and then extrapolating a matching spectrum using an array of LEDs representing the visible light range. However, this patent does not appear to contain any teachings with respect to improving color performance of a dimming fluorescent lamp such that its color spectrum and color temperature are maintained as the lamp is dimmed, or for otherwise correcting the light output from a fluorescent lamp.

Academy Award winning Kino Flo Lighting Systems in Burbank Calif. developed full spectrum fluorescent lamps that render colors accurately for various imaging applications. These lamps eliminated much of the color corrective filtering that was required for architectural lamps with deficient spectrums. The industry has noted that as fluorescent lamps dim they shift in color temperature and light output drops. Because each fixture can be dimmed to a different level, the degree of color shift can vary greatly from fixture to fixture. For a lighting director to add color correction gel or filters to all the dimmed fixtures would require a great deal of time and expense to determine the degree of filtration necessary. The discoloration of the light as a result of gelling further alienated artists from wanting to dim fluorescent lamps. As a result dimming fluorescent fixtures have a limited acceptance rate amongst most film or TV lighting professionals.

SUMMARY OF THE INVENTION

The present invention sets out to eliminate the need for color correction gels to correct a shifting spectrum as a result of dimming a fluorescent lamp. It allows a fluorescent lamp to be dimmed while maintaining a constant spectral distribution and color temperature. The invention also uses the fluorescent lamp bulb wall as a diffuser to conceal the additional light sources. This prevents the eye, when viewing the fixture directly, from seeing the additional separate sources or perceiving a coloration shift, as with topically applied filters, as the desired portion of the spectrum is maintained.

The present invention uses a green 550 nm light source positioned on one side of a reflector with a single fluorescent lamp or a plurality of fluorescent lamps positioned on the other side of the reflector. Holes in the reflector allow light from the green 550 nm light source to pass through the fluorescent lamp or lamps. The invention further includes a lighting control mechanism, which adjusts the green source's light level in correlation to the degree of dimming of the fluorescent lamp.

The reflector has small apertures or holes positioned along the lamp axis to allow the green light to shine through the reflector. The reflector holes act as a light guide and concentrate the light onto the center line or axis of the lamp in such a way that the fluorescent lamp absorbs the green light. The green light is not directly shining out from the fixture so as to be seen by someone looking into the fixture. The white phosphor coatings of the lamps act as a diffuser.

The array can use a plurality of green LEDs or small narrow fluorescent lamps displaying a spectral peak aligned to the spectral peak of the fluorescent lamp. This spectral peak generally falls at or about 545 to 550 nanometers. As the fluorescent lamp is dimmed, the mercury pressure inside the lamp drops affecting the green part of the spectrum. As the green spectrum is reduced a control loop engages the green light source to replenish that part of the spectrum that diminished during the dimming of the fluorescent lamp.

DETAILED DESCRIPTION OF THE INVENTION

Figure 1:
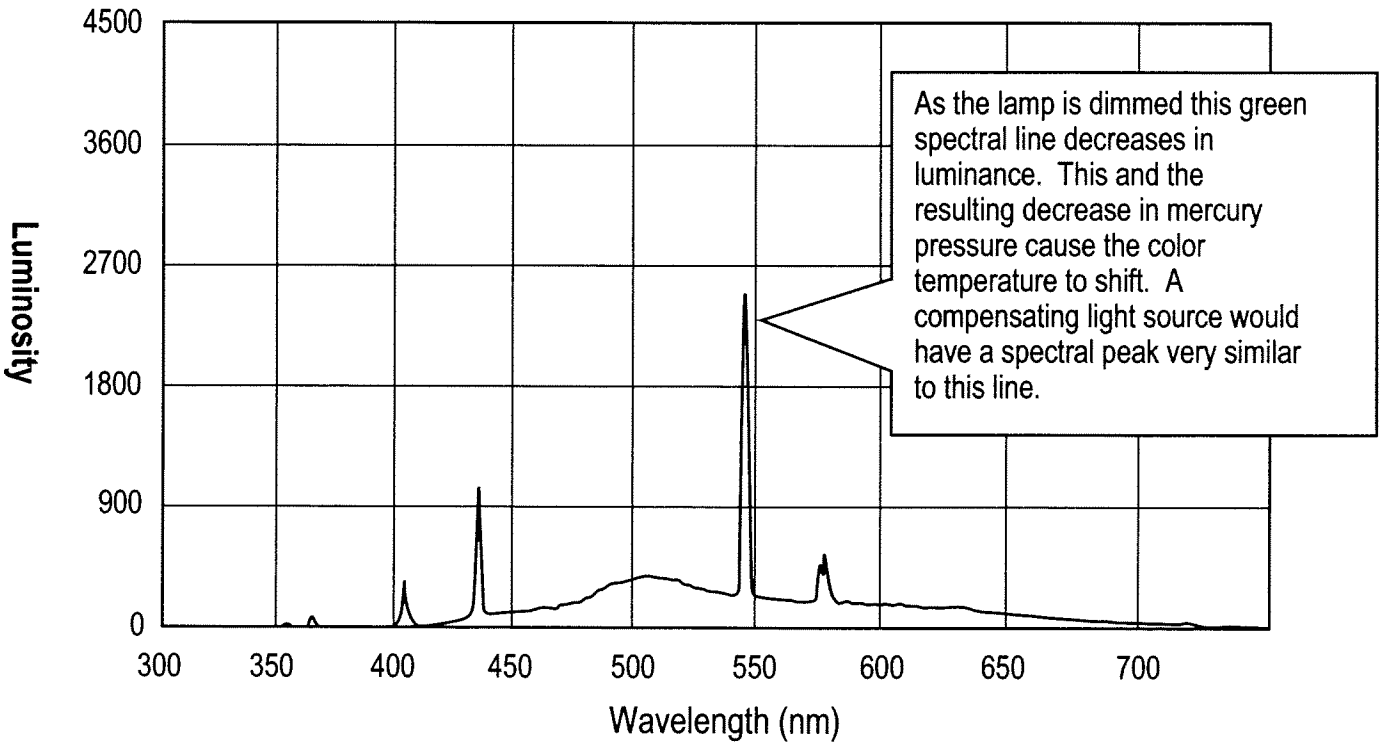
FIG. 1 is a graph showing the spectral peak of a fluorescent lamp when fully lit.

As shown in FIG. 1, a fluorescent lamp of the type using in the motion picture industry with its designed full voltage applied, has a luminosity peak at a wavelength near 550 nm which appears to the human eye as green. As the lamp is dimmed, the 550 nm spectral line decreases in luminance. This and the resulting decrease in mercury pressure causes the color temperature of the lamp to shift from more green to more magenta.

Thus, to compensate for this shift, it is necessary to add light from the green spectrum.

The position of the green source is critical as the lamps have to act as a diffuser. The green source must subtly blend and absorb into the light of the fluorescent lamp. If direct green light were to shine out from the fixture it would visibly display more green to the human eye than would be recorded by cameras. Human eyes perceive green more dominantly than recording technology and would hamper visual color perception and evaluation of color relationships.

Although this description is focused on the use of a green light source for the purpose of compensating for the color temperature shift of a fluorescent lamp as it is being dimmed, the invention of blending colored light though a fluorescent lamp can also be applied to modifying portions of a fluorescent lamp spectrum for other situations. For example, some lower cost lamps that display spectral deficiencies when used for imaging applications could be corrected by injecting or replenishing the portion lacking. This could be accomplished by using the invention to incorporate red, green and/or blue light sources and adjusting their light levels to approximate the lacking spectrum when used in conjunction with the lamp as described herein. For example, instead of a green light source, a multicolor light source having red, blue and green components can be used whose color can be controlled by applied control signals. Such multicolor LEDs and the programming to control such LEDs are well known to persons skilled in the art.

Dimming fluorescents can introduce flicker or perceived flicker when recording moving images. A common dimming technique is to employ phase-shift dimming principles to attenuate light levels. Care must be taken to ensure a high enough frequency of dimming operation to avoid camera flicker. However, such dimming techniques for fluorescent lamps are well known, and, therefore, are not described herein.

For convenience, in the following description, LEDs are being used as an example, but other sources of light which produce a colored light at a desired wavelength can also be used. Also, the description refers to an embodiment in which green LEDs are used to compensate for a green color shift when a fluorescent lamp is dimmed. However, using LEDs of other colors or multicolor LEDs, is also possible in which case the light output from the fluorescent lamp is modified based on the specific LEDs used and the color they produce.

Figure 2:
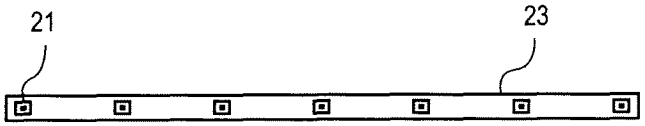
FIG. 2 shows an array or matrix of green LEDs arranged on a metal substrate for affixing to a reflector used in a fluorescent lamp system.

Referring to FIG. 2, an array of green light sources such as LEDs 21 is arranged on substrate 23. The length of the substrate should be close to the length of the fluorescent lamp which needs compensation, with the LEDs substantially equally spaced. The LEDs should be selected to generate light at a wavelength of about 550 nm which appears to the human eye as green.

Figure 3A:
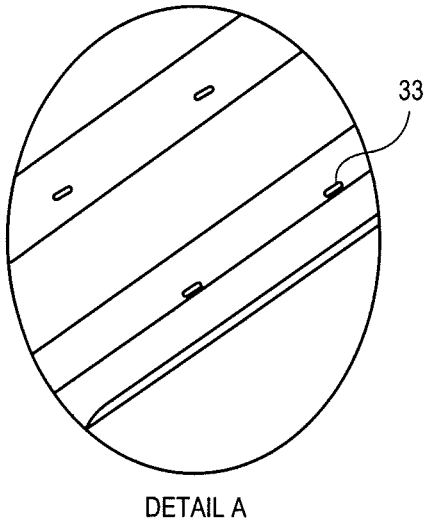
FIG. 3*a* shows with detail A from FIG. 3 showing oblong shape of apertures for the LEDs.
Figure 3:
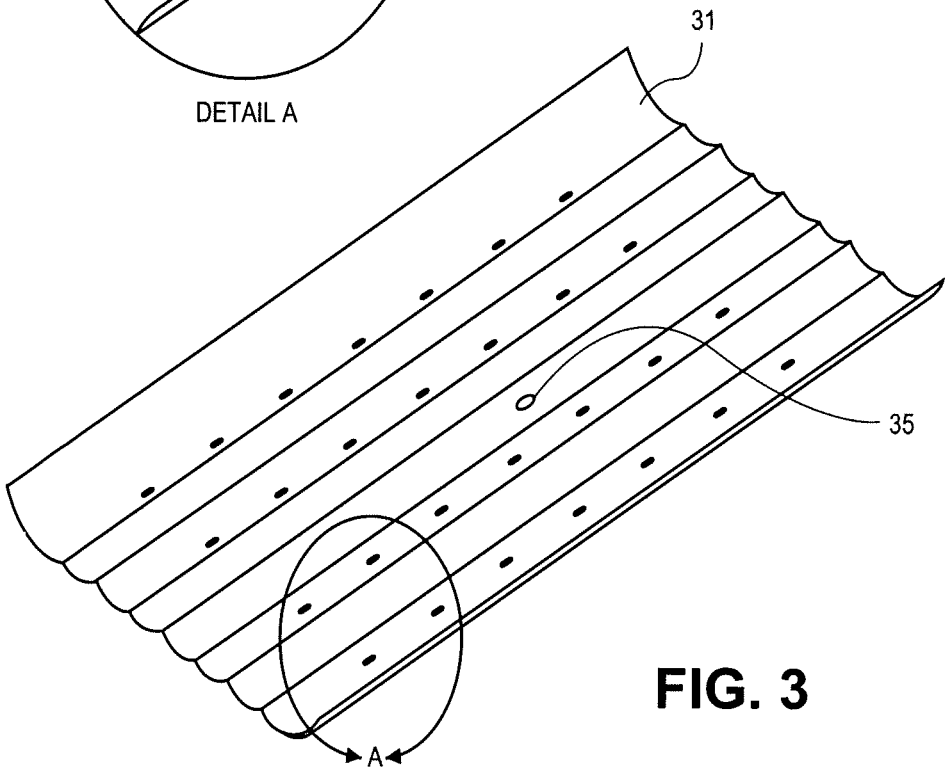
FIG. 3 shows deflector detail of light guides or apertures.

Referring now to FIG. 3, a reflector 31 of the type used in conjunction with fluorescent lamps is shown. However, the reflector 31 is modified to include apertures 33 as best seen in the detail view shown in FIG. 3*a*. The apertures should be spaced so that they correspond to the spacing of the LEDs 21 on substrate 23. An aperture 35 is also provided for a sensor as described below in connection with FIGS. 4*a*, 4*b* and 5.

Figure 4A:
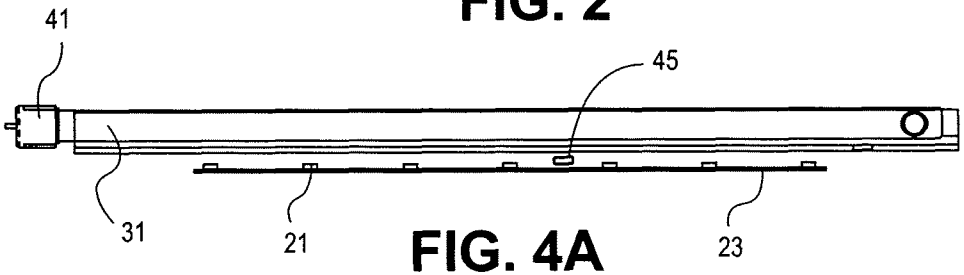
FIG. 4*a* shows a side view of a reflector and LED array positioned under the reflector.
Figure 4B:
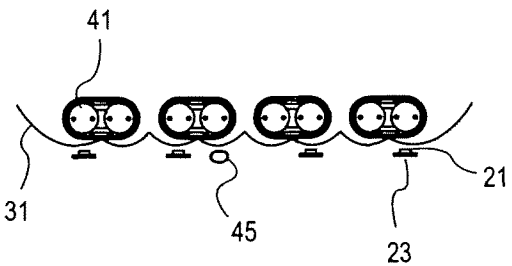
FIG. 4*b* shows an end view of a reflector and LED array positioned under the reflector.
Figure 5:
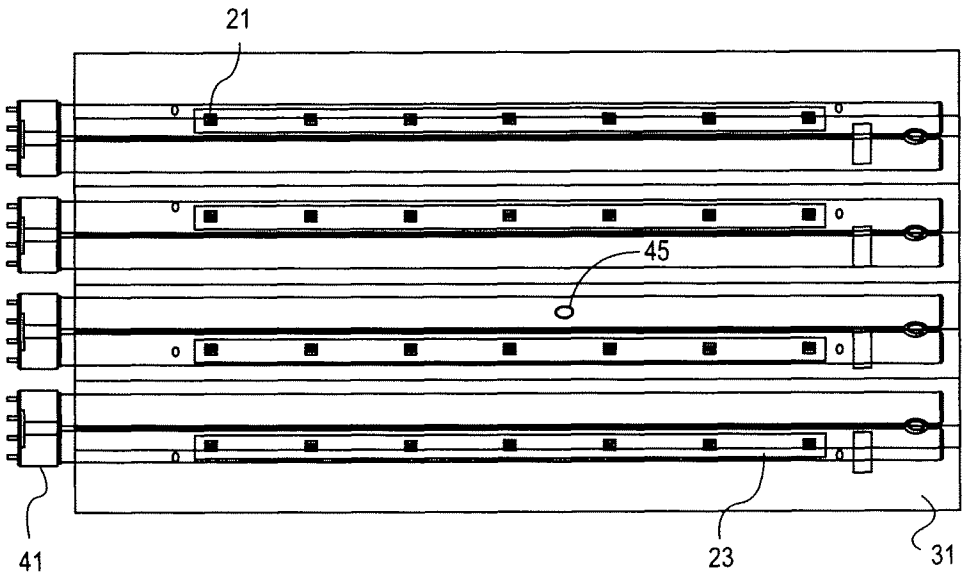
FIG. 5 shows a top view of a transparent reflector and LED array positioned under the reflector.

FIG. 4*a* shows the side view of reflector 31 with LEDs 21 positioned on the reflector so as to line up with apertures 33. Although it is not possible to see apertures 33 in FIG. 4*a*, the apertures 33 and LEDs 21 must be lined up so that light from the LEDs passes through apertures 33. Also shown in FIGS. 4*a* and 4*b* are fluorescent lamps 41 and sensor 45. FIG. 4*a* shows the arrangement of the fluorescent lamps 41 and reflector 31 from the side. FIG. 4*b* is similar except that it shows lamps 41 from one end. In this connection, it should be noted that each of the lamps 41 although shown as a pair of tubes, constitutes a single lamp known as a compact fluorescent lamp (CFL). For this reason, the apertures and LEDs need only be lined up along one tube of the pair forming a single compact fluorescent lamp. However, the invention is not limited to the use of CFL as any type of fluorescent lamp may be used. Additionally, although not shown, persons skilled in the art will recognize that power is supplied to the lamps via pins extending from ends of the lamp, and that a dimming control is used to control the amount of power supplied to the lamp.

In an alternate embodiment, instead of the LEDs and sensor being on one side of a reflector, the invention can be implemented without using a reflector in which case the LEDs and sensor can be affixed directly on the lamp. The only requirement is that the LEDs must be arranged so that the light they give off is diffused by the lamp.

Figure 6:
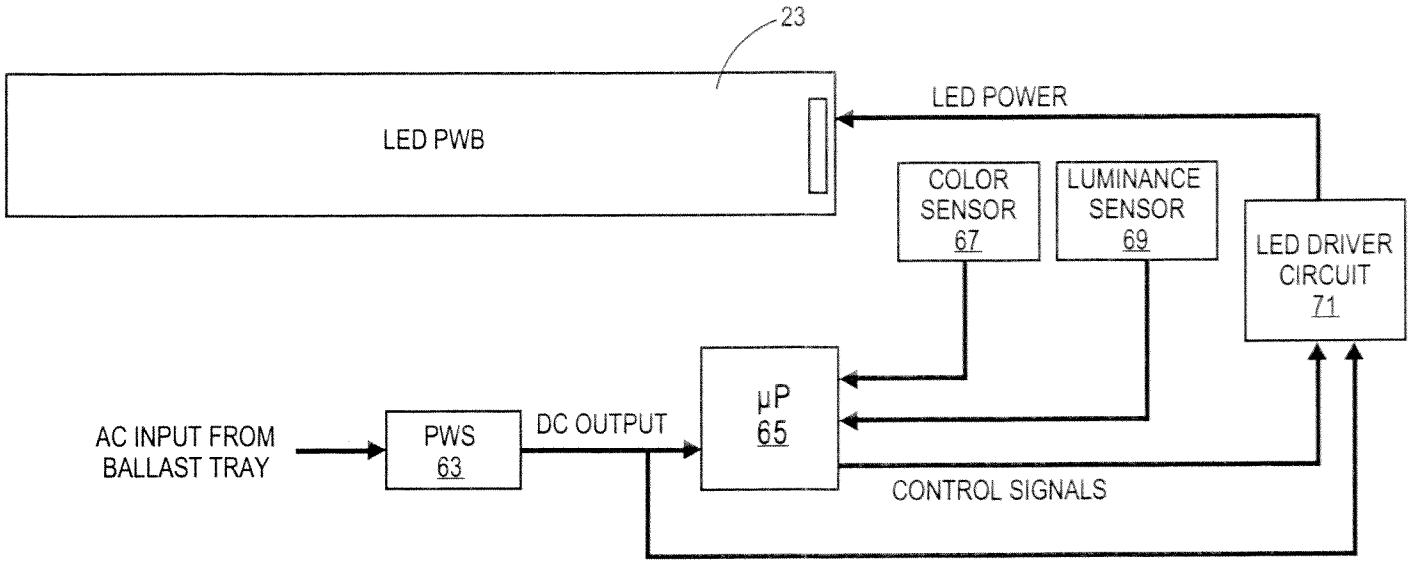
FIG. 6 is a schematic of an LED driver circuit for use with a dimming fluorescent lamp according to an embodiment of the invention using one or more sensors and a microprocessor.

Referring now to FIG. 6, AC voltage is applied to a power supply (PWS) 63 which provides overall DC voltage to the circuit sub components. A microprocessor 65 is used to generate a pulse width modulated control signal applied to the LED driver circuit 71. The microprocessor provide this functionality based on inputs received from color sensor 67 and/or luminance sensor 69. The modulated signal controls the amount of power applied to the LEDs on substrate 23 which is an LED printed wiring board (PWB) though LED driver circuit 71 which varies the LED luminance.

The luminance sensor is used for positive feedback to the microprocessor, which ensures that the LEDs produce light at an appropriate level for the lamps when a dimming control (not shown) is manipulated.

In one embodiment, the color sensor 67 and luminance sensor 69 are implemented using a single part such as an AV02-0191EN ADJD sensor available from Avago Technologies. Alternatively, a photodiode sensor which detects 550 nm+−10 nm available from Photonic Detectors can be used. Notwithstanding that only single sensor is shown even though there are four separate lamps, since the same dimming control is applied to all the lamps, the spectral shift as measured for one lamp can be applied to all lamps.

The photo sensor/spectrometric sensor evaluates the spectrum being produced by the fluorescent lamp and the programmed microprocessor adjusts the green light source's luminance to maintain a constant color temperature. In this connection, the specifics of the programming necessary would be dependent on the particular sensors and driver circuit utilized. Such specifics are not needed for a proper understanding of the invention and are well within the abilities of persons skilled in the art. Similarly, instead of the microprocessor being programmed to adjust the green light source, when used to provide color compensation, feedback from sensors 67 and/or 69 is provided to the microprocessor which is programmed to generate a control signal used by LED driver circuit 71 to provide power to the LEDs which results in the LEDs providing a color which when diffused by the fluorescent lamp results in the desired color compensation.

Another simpler mechanism (not shown) would be to have a control loop that monitors lamp current or luminance from the dimmer control (not shown) applied to the provided to a microprocessor which would use the information provided by the dimmer control to control the LED driver circuit. While this would avoid the use of a sensor, since based on an input from the dimmer rather than the light output from the lamps, the correction may not be as accurate.

Figure 7:
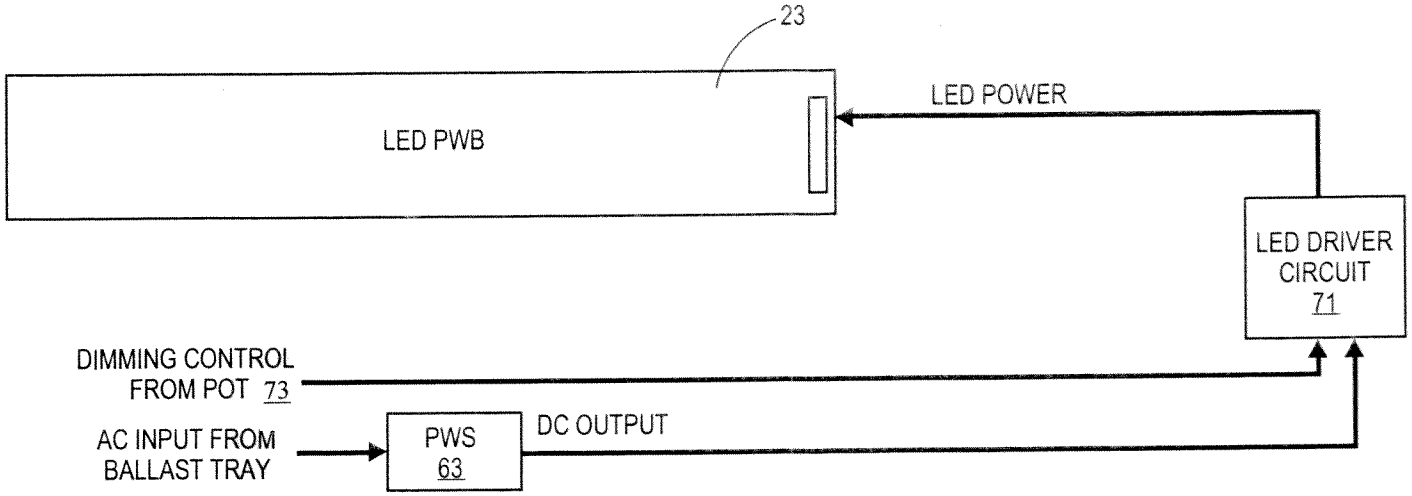
FIG. 7 is a schematic of an LED driver circuit for use with a dimming fluorescent lamp according to an embodiment of the invention using a manually adjusted potentiometer.

Also, and referring now to FIG. 7, instead of the microprocessor and sensor arrangement shown in FIG. 6, a potentiometer 73 can be used to directly control LED driver circuit 71. In this case, the fluorescent lamp dimmer control could be set up with, for example, a number of detents corresponding to four positions, full light output, one f-stop dimmed, two f-stop dimmed and three f-stop dimmed. Settings on the potentiometer could then be set which would correspond to the four possible dimmer control settings.

Although specific implantation details are set forth herein, such details should not be construed as limiting the scope of the invention which is defined according to the following claims.

We claim:

1. A system for improving a color performance of a fluorescent lamp comprising:

a reflector having an aperture;

a light source positioned with respect to a fluorescent lamp and the aperture so that the lamp diffuses the light which passes through the aperture emanating from the light source;

a controller for controlling the luminance of the light source such that a color temperature of the diffused light from the fluorescent lamp is maintained at a predetermined level.

2. The system defined by claim 1, wherein said aperture acts as a light guide for the light source.

3. The system defined by claim 2 wherein the sensor is positioned adjacent a sensor aperture in the reflector, said sensor aperture aligned with an axis of said lamp.

4. The system defined by claim 1 wherein the color temperature of the fluorescent lamp is maintained as the lamp is dimmed.

5. The system defined by claim 4 wherein the light source has a predetermined wavelength.

6. The system defined by claim 5 wherein the predetermined wavelength is 550 nm.

7. The system defined by claim 1 wherein the controller comprises:

a sensor positioned to determine at least one of color and luminance of the lamp; a microprocessor coupled to the sensor and configured to generate a control signal;

a driver circuit coupled to the microprocessor and the light source, said driver circuit using said control signal to provide an amount of power to the light source to maintain the color temperature of light from the fluorescent lamp at the predetermined level.

8. The system defined by claim 7 wherein the sensor is a combination color and luminance sensor.

9. The system defined by claim 7 wherein the sensor is a photodiode.

10. The system defined by claim 1 wherein the controller comprises:

a potentiometer;

a driver circuit coupled to the potentiometer and the light source, said driver circuit using a control signal from said potentiometer to provide an amount of power to the light source to maintain the color temperature of light from the fluorescent lamp at the predetermined level.

11. A method for improving a color performance of a fluorescent lamp comprising:

providing a light source;

transmitting the light source through an aperture in a reflector, said aperture guiding the light from the light source so that the light from the light source passes through the lamp, the lamp diffusing the light emanating from the light source which passes through the aperture;

controlling the luminance of the light source such that a color temperature of the diffused light from the fluorescent lamp is maintained at a predetermined level.

12. The method defined by claim 11 wherein the color temperature of the fluorescent lamp is maintained as the lamp is dimmed.

13. The method defined by claim 12 wherein the light source has a predetermined wavelength.

14. The method defined by claim 13 wherein the predetermined wavelength is 550 nm.

15. The method defined by claim 11 wherein the controlling comprises:

positioning a sensor so as to determine at least one of color and luminance of the lamp;

generating a control signal using the determined at least one of color and luminance;

providing an amount of power to the light source using said control signal to maintain the color temperature of light from the fluorescent lamp at the predetermined level.

16. The method defined by claim 15 wherein the sensor is positioned adjacent a sensor aperture in the reflector, said sensor aperture aligned with an axis of said lamp.

17. The method defined by claim 11 wherein the controlling comprises:

using a control signal from a potentiometer to provide an amount of power to the light source so as to maintain the color temperature of light from the fluorescent lamp at the predetermined level.

* * * * *